US011264692B2

(12) United States Patent
Itou

(10) Patent No.: US 11,264,692 B2
(45) Date of Patent: Mar. 1, 2022

(54) ANTENNA UNIT

(71) Applicant: Yazaki Corporation, Tokyo (JP)

(72) Inventor: Eita Itou, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/669,464

(22) Filed: Oct. 30, 2019

(65) Prior Publication Data

US 2020/0144694 A1 May 7, 2020

(30) Foreign Application Priority Data

Nov. 2, 2018 (JP) ..... JP2018-207132

(51) Int. Cl.

| | |
|---|---|
| ***H01Q 1/38*** | (2006.01) |
| ***H01Q 1/12*** | (2006.01) |
| ***H01P 3/08*** | (2006.01) |
| ***H01Q 1/48*** | (2006.01) |
| ***H01Q 9/04*** | (2006.01) |

(52) U.S. Cl.

CPC ..... *H01Q 1/12* (2013.01); *H01P 3/081* (2013.01); *H01Q 1/48* (2013.01); *H01Q 9/045* (2013.01)

(58) Field of Classification Search

CPC ..... H01Q 1/12; H01Q 1/48; H01Q 9/045; H01Q 1/22; H01Q 9/0407; H01Q 1/38; H01Q 1/1221; H01Q 1/405; H01Q 1/42; H01Q 1/50; H01Q 1/32; H01Q 1/40; H01P 3/081

See application file for complete search history.

(56) References Cited

U.S. PATENT DOCUMENTS

| | | | | |
|---|---|---|---|---|
| 5,798,734 | A * | 8/1998 | Ohtsuka | H01Q 9/0414 343/700 MS |
| 6,002,370 | A * | 12/1999 | Mckinnon | H01Q 1/38 343/700 MS |
| 6,362,786 | B1 | 3/2002 | Asano et al. | |
| 2011/0057853 | A1* | 3/2011 | Kim | H01Q 1/48 343/843 |
| 2013/0229299 | A1 | 9/2013 | Matsuzawa et al. | |
| 2017/0104275 | A1* | 4/2017 | Yanagisawa | H01Q 9/38 |

FOREIGN PATENT DOCUMENTS

| | | | |
|---|---|---|---|
| CN | 202189889 | U | 4/2012 |
| CN | 103004017 | A | 3/2013 |
| CN | 107078395 | A | 8/2017 |
| EP | 0 697 139 | A | 3/2017 |
| JP | 61-284102 | A | 12/1986 |
| JP | 05243836 | A * | 9/1993 |
| JP | 2013-58893 | A | 3/2013 |
| JP | 2017-63364 | A | 3/2017 |
| WO | 95/24746 | A1 | 9/1995 |
| WO | 2015/200754 | A1 | 12/2015 |

* cited by examiner

*Primary Examiner* — Dieu Hien T Duong
(74) *Attorney, Agent, or Firm* — Kenealy Vaidya LLP

(57) ABSTRACT

An antenna unit includes a patch antenna and a case. The patch antenna includes a conductive antenna pattern and an antenna ground pattern that functions as ground of the antenna pattern and receives an electric wave. The case has dielectricity, the case being provided with the patch antenna. The antenna pattern is provided on an inner wall surface of a wall portion of the case. The antenna ground pattern is provided on an outer wall surface of a wall portion of the case and is positioned so as to face the antenna pattern.

2 Claims, 5 Drawing Sheets

ANTENNA UNIT

CROSS-REFERENCE TO RELATED APPLICATION(S)

The present application claims priority to and incorporates by reference the entire contents of Japanese Patent Application No. 2018-207132 filed in Japan on Nov. 2, 2018.

BACKGROUND OF THE INVENTION

1. Field of the Invention

The present invention relates to an antenna unit.

2. Description of the Related Art

Hitherto, as an antenna unit, for example, there has been an antenna that includes a film having dielectricity, an antenna pattern formed on one side of the film, and a ground pattern formed on the other side of the film. In this connection, Japanese Patent Application Laid-open No. 2017-63364 discloses a printed circuit board, in which an antenna pattern (monopole antenna) that transmits and receives an electric wave is formed.

The above-mentioned antenna may be mounted on, for example, a vehicle etc. in a state where it is accommodated in a housing. In this case, although the antenna is assembled in the inside of the housing, there is a room for further improvement in the point that assembles the antenna in the housing.

SUMMARY OF THE INVENTION

Then, the present invention is made in view of the above, and an object is to provide an antenna unit that can assemble an antenna in a housing properly.

In order to solve the above mentioned problem and achieve the object, an antenna unit according to one aspect of the present invention includes an antenna that includes a conductive antenna pattern and a first ground pattern that functions as ground of the antenna pattern, the antenna transmitting or receiving an electric wave; and a case that has dielectricity, the case being provided with the antenna, wherein the antenna pattern is provided on a wall surface on one side of a wall portion of the case, and the first ground pattern is formed on a wall surface on the other side of the wall portion and is positioned so as to face the antenna pattern.

According to another aspect of the present invention, in the antenna unit, it is preferable that the antenna pattern is provided on the wall surface inside the case and is accommodated in an inner space portion of the case, and the first ground pattern is formed on the wall surface outside the case.

According to still another aspect of the present invention, in the antenna unit, it is preferable that the antenna includes a sheet-shaped film having dielectricity, and the antenna pattern is formed on a film surface on one side of the film and is provided on the wall surface of the case with the film interposed therebetween.

According to still another aspect of the present invention, in the antenna unit, it is preferable that the antenna unit includes a microstripline that includes a conductive power supply pattern and a second ground pattern functioning as ground of the power supply pattern and is configured to transmit electric power to the antenna, wherein the power supply pattern is formed on a film surface on the one side, and the second ground pattern is formed on a film surface on the other side of the film and is positioned so as to face the power supply pattern.

According to still another aspect of the present invention, in the antenna unit, it is preferable that the antenna pattern is formed on the wall surface of the case.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A mode (embodiment) for carrying out the present invention will be described in detail, with reference to drawings. The present invention is not limited by contents described in the following embodiments. Moreover, constituent elements described below include those that can be easily conceived by the person skilled in the art and those that are substantially the same. Furthermore, it is possible to combine configurations described below as appropriate. Moreover, various omissions, substitutions or changes in the configurations may be made without departing from the scope of the present invention.

First Embodiment

Figure 1:
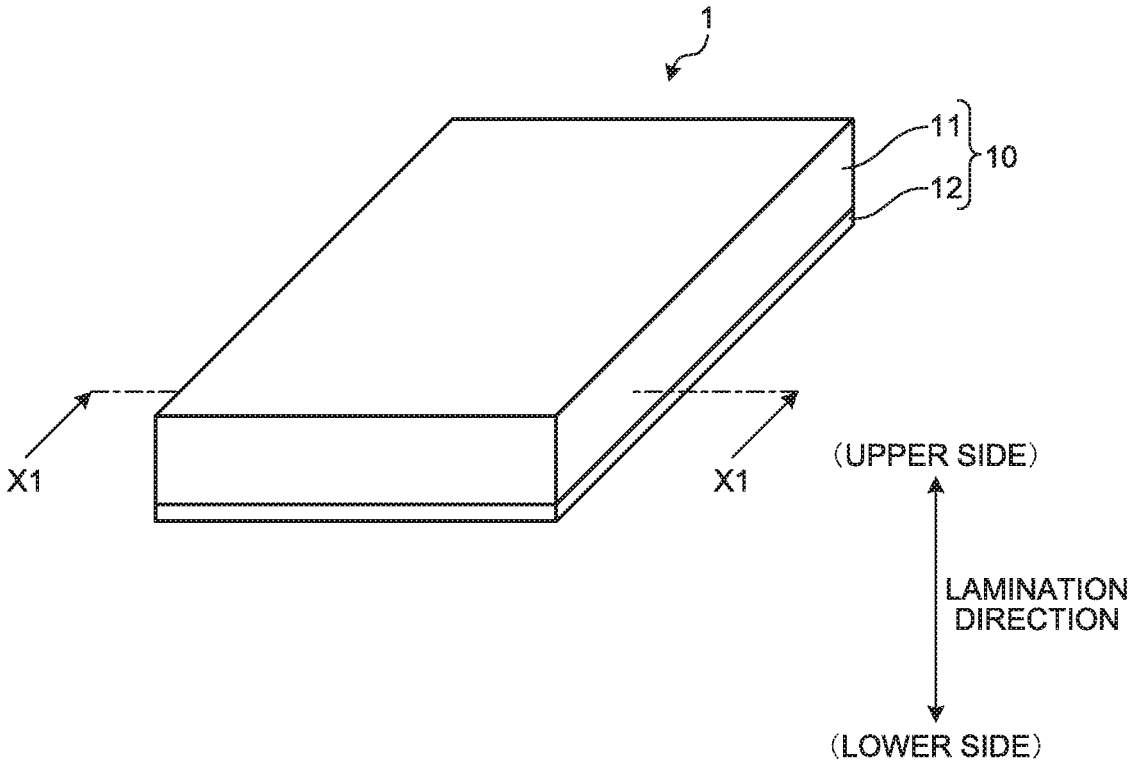
FIG. 1 is a perspective view illustrating a configuration example of an antenna unit according to a first embodiment.
Figure 2:
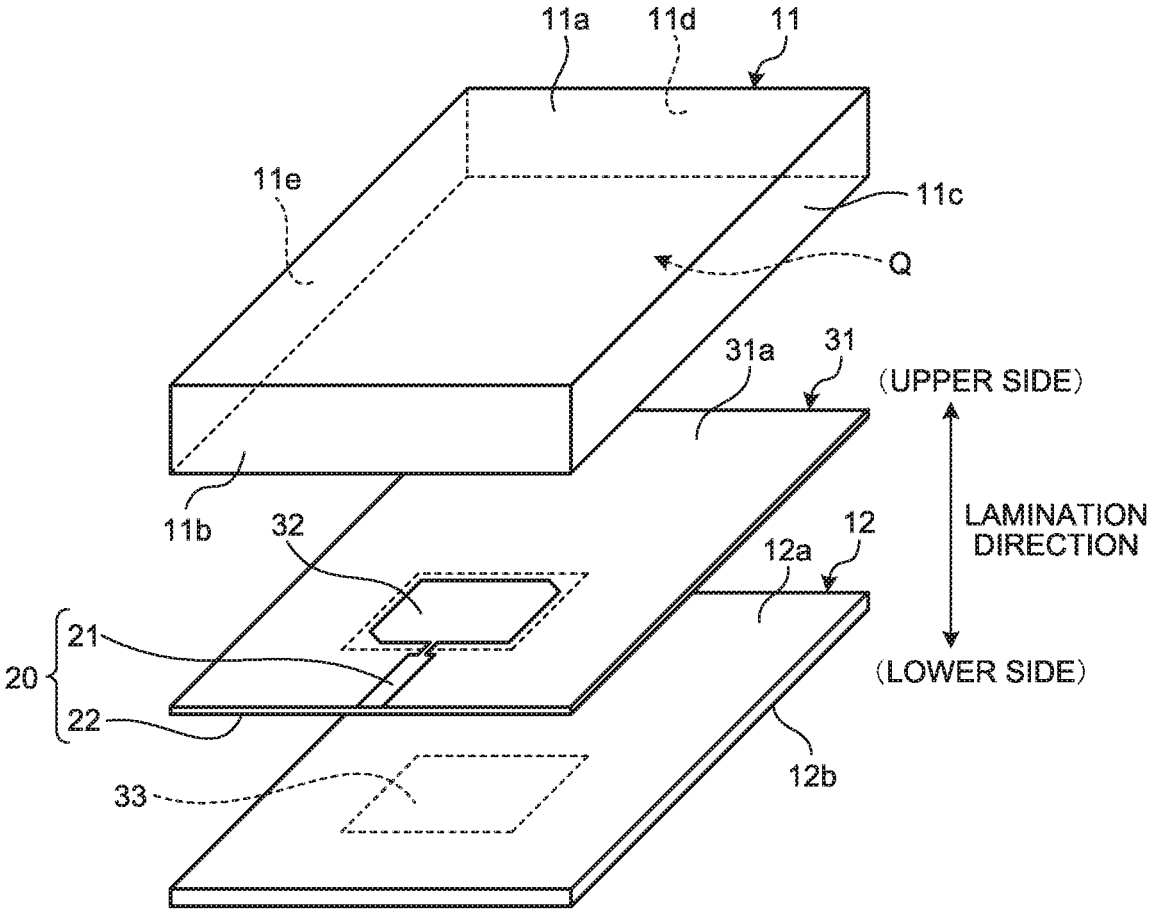
FIG. 2 is an exploded perspective view illustrating a configuration example of the antenna unit according to the first embodiment.
Figure 3:
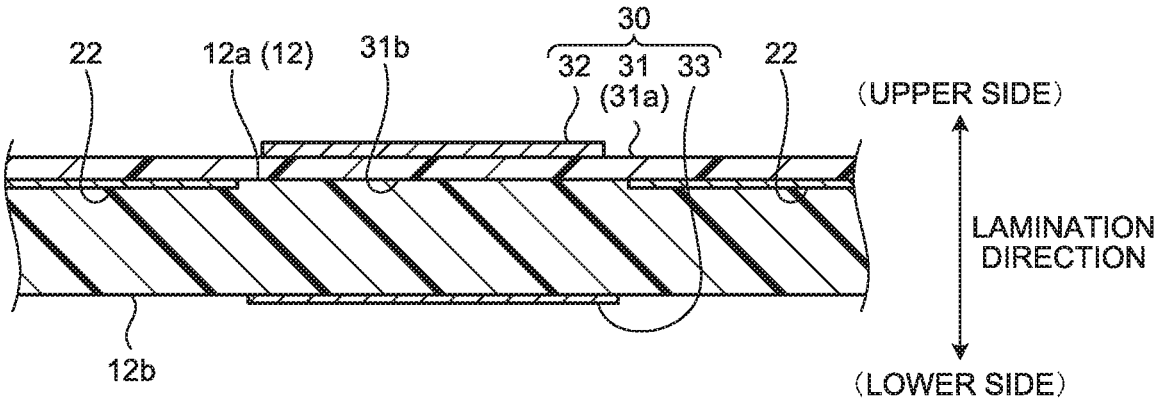
FIG. 3 is a sectional view along an X1-X1 line in FIG. 1.

An antenna unit 1 according to a first embodiment will be described, with reference to the drawings. FIG. 1 is a perspective view illustrating a configuration example of the antenna unit 1 according to the first embodiment. FIG. 2 is an exploded perspective view illustrating a configuration example of the antenna unit 1 according to the first embodiment. FIG. 3 is a sectional view along an X1-X1 line in FIG. 1.

The antenna unit 1 receives an electric wave. For example, as illustrated in FIG. 1 to FIG. 3, the antenna unit 1 includes a case 10 as a housing, a microstripline 20, and a patch antenna 30 as an antenna.

Here, a direction in which a below-mentioned antenna pattern 32 and film 31 of the patch antenna 30 are laminated is referred to as a lamination direction. Moreover, in the lamination direction, an antenna pattern 32 side is referred to as an upper side of the lamination direction, and a film 31 side is referred to as a lower side of the lamination direction. Also, the upper side of the lamination direction is referred to as an upper case 11 side and the lower side of the lamination direction is referred to as a lower case 12 side.

The case 10 is a case to which the patch antenna 30 and the microstripline 20 are assembled. One or a plurality of patch antennas 30 and one or a plurality of microstriplines 20 are assembled to the case 10. The case 10 has dielectricity, and is formed, for example, of a polycarbonate-acrylonitrile, butadiene, and styrene mixture (PC-ABS) resin. The case 10 is formed in a box shape, and includes an upper case 11 and a lower case 12. The upper case 11 is formed in a rectangular parallelepiped shape, and includes a ceiling plate 11*a* and four side wall plates 11*b* to 11*e*. The ceiling plate 11*a* is formed in a rectangular flat plate shape, and is located on an upper side in the lamination direction. Each of the side wall plates 11*b* to 11*e* is formed in a rectangular flat plate shape, and is disposed along the circumference direction of the ceiling plate 11*a*. The side wall plates 11*b* to 11*e* extend from the respective sides of the ceiling plate 11*a* toward a lower side along the lamination direction and surround circumference of the ceiling plate 11*a*. The upper case 11 forms an inner space portion Q by the ceiling plate 11*a* and each of the side wall plates 11*b* to 11*e*. The upper case 11 has an opening portion on a lower side of the lamination direction (a side opposite to the ceiling plate 11*a*).

The lower case 12 closes the opening portion of the upper case 11. The lower case 12 is formed in a rectangular flat plate shape, and engaged with the opening portion of the upper case 11. In the lower case 12, it is preferable that, for example, a dielectric constant (e) is approximately three and that a thickness in the lamination direction is approximately in a range of 1 mm to 2 mm. Typically, in the lower case 12, the thickness in the lamination direction is approximately 1 mm.

Figure 4:
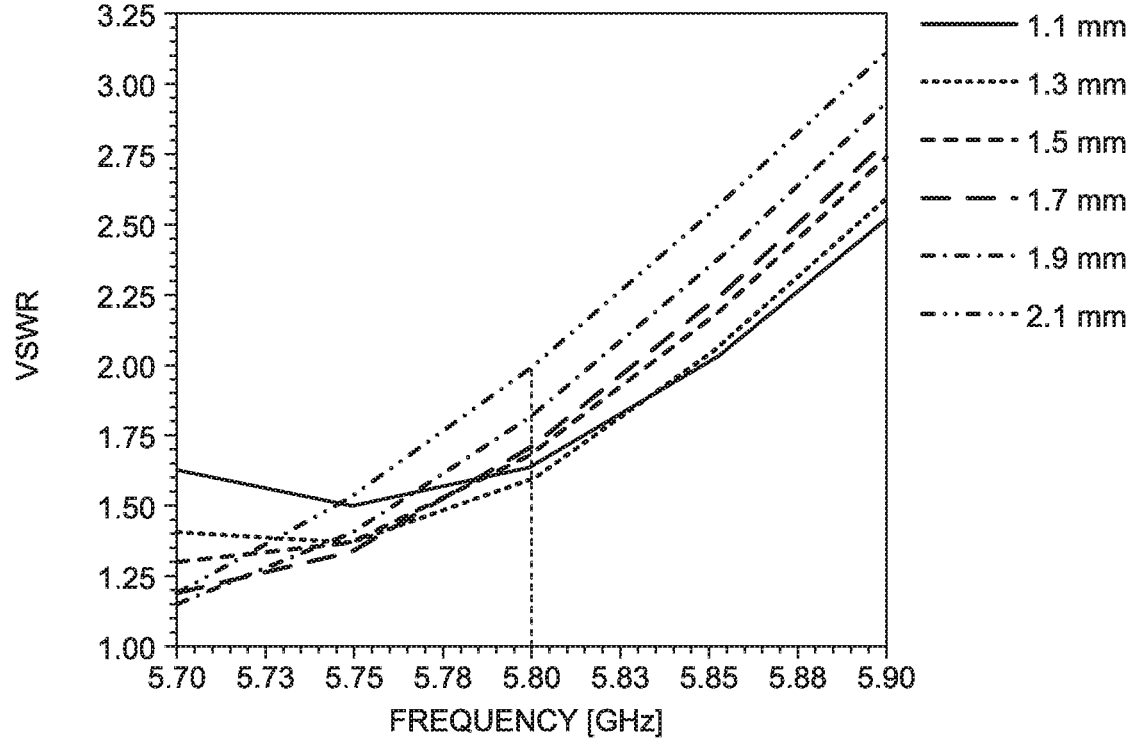
FIG. 4 is a diagram illustrating a relation between a thickness of a lower case and a voltage standing wave ratio (VSWR)
Figure 5:
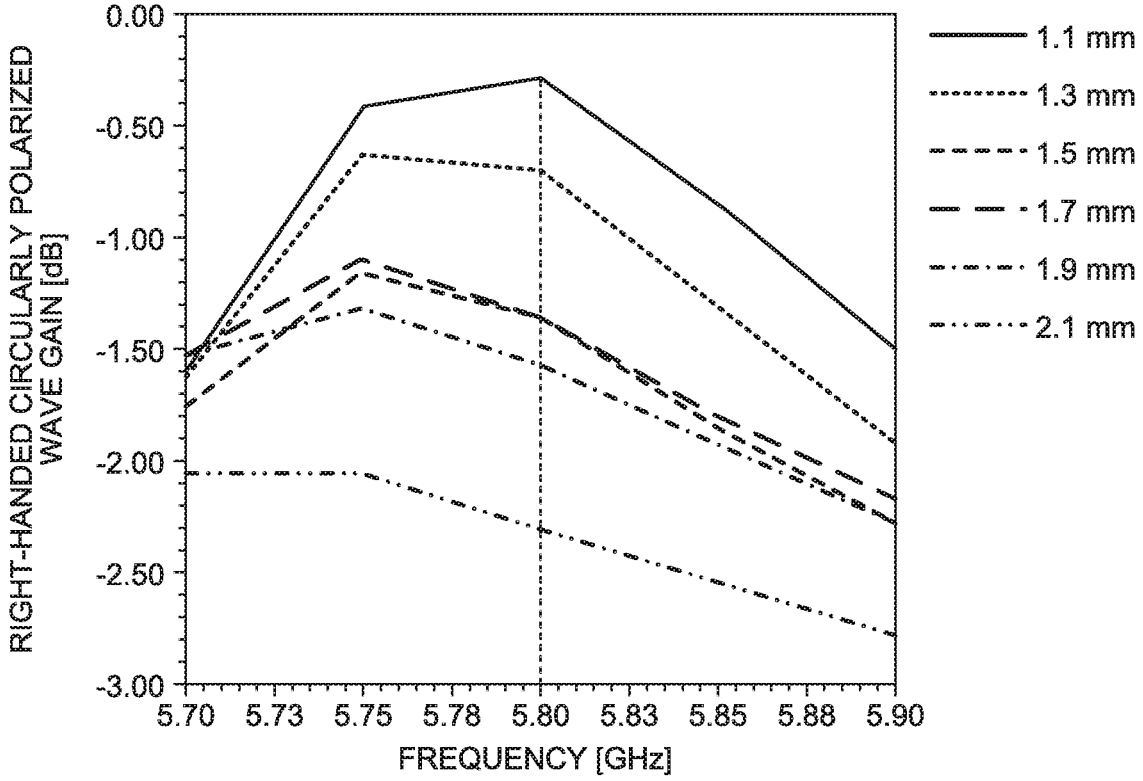
FIG. 5 is a diagram illustrating a relation between the thickness of the lower case and a right-handed circularly polarized wave gain.

Here, FIG. 4 is a diagram illustrating a relation between the thickness of the lower case 12 and a voltage standing wave ratio (VSWR). FIG. 5 is a diagram illustrating a relation between the thickness of the lower case 12 and a right-handed circularly polarized wave gain. Each of FIG. 4 and FIG. 5 illustrates a simulation result in the case where the thickness of the lower case 12 increases by 0.2 mm, from 1.1 mm to 2.1 mm. The antenna unit 1, for example, as illustrated in FIG. 4, when a frequency is 5.8 GHz, in the case where the thickness of the lower case 12 is 1.3 mm, the VSWR becomes the smallest, and in the case where the thickness of the lower case 12 is 2.1 mm, the VSWR becomes the largest. The antenna unit 1 has a tendency to have, in a range where the thickness of the lower case 12 is 1.5 mm to 2.1 mm, a larger VSWR as the thickness of the lower case 12 becomes thicker. In the antenna unit 1, in the case where the thickness of the lower case 12 is 2.1 mm, the VSWR becomes 2.0. Accordingly, the upper limit of the thickness of the lower case 12 is approximately 2 mm.

Moreover, in the antenna unit 1, for example, as illustrated in FIG. 5, when the frequency is 5.8 GHz, in the case where the thickness of the lower case 12 is 1.1 mm, the right-handed circularly polarized wave gain becomes the largest, and in the case where the thickness of the lower case 12 is 2.1 mm, the right-handed circularly polarized wave gain becomes the smallest. The antenna unit 1 has a tendency to have, in a range where the thickness of the lower case 12 is 1.1 mm to 2.1 mm, a smaller right-handed circularly polarized wave gain as the thickness of the lower case 12 becomes thicker.

In the case 10, in a state where the lower case 12 is engaged with the opening portion of the upper case 11, the microstripline 20 and a part of the patch antenna 30 are accommodated in the inner space portion Q. The case 10 is mounted on, for example, a vehicle etc. and disposed such that the upper case 11 faces a ceiling side of the vehicle.

The microstripline 20 transmits electric power. The microstripline 20 is formed on a below-mentioned film 31 of the patch antenna 30. The microstripline 20 is provided on an inner wall surface 12*a* side of a wall portion of the lower case 12 and is positioned in the inner space portion Q. The microstripline 20 includes a power supply pattern 21 and a power supply ground pattern 22. The power supply pattern 21 is formed on the film 31. The power supply pattern 21 is formed by, for example, printing (for example, screen-printing) a conductor, such as a silver paste, on the film 31. The power supply pattern 21 is formed on an upper side, in the lamination direction, of the film 31, i.e., a surface 31*a* of the film 31. In other words, the power supply pattern 21 is formed on an antenna pattern 32 side of the film 31. The power supply pattern 21 is formed in a line shape, in which one end is connected to the antenna pattern 32 and the other end is connected to a receiving section (not illustrated) that receives a signal.

The power supply ground pattern 22 is a conductive pattern. As illustrated in FIG. 3, the power supply ground pattern 22 is formed on the film 31. The power supply ground pattern 22 is formed by, for example, printing (for example, screen-printing) a conductor, such as a silver paste, on the film 31. The power supply ground pattern 22 is formed on a side of the film 31 opposite to the power supply pattern 21. That is, the power supply ground pattern 22 is formed on a lower side, in the lamination direction, of the film 31 (a back surface 31*b* of the film 31). The power supply ground pattern 22 is positioned so as to face the power supply pattern 21 along the lamination direction and functions as a ground that is a reference potential of the power supply pattern 21.

In the microstripline 20, the line width of the power supply pattern 21 can be maintained at a desired width length by forming the power supply ground pattern 22 on the back surface 31*b* of the film 31, without forming it on an outer wall surface 12*b* of the lower case 12. Here, in the microstripline 20, the characteristic impedance is decided by the line width of the power supply pattern 21, the thickness of the power supply pattern 21, the thickness of a dielectric body, and a dielectric constant. In the microstripline 20, in the case where the characteristic impedance is, for example, 50Ω, as a dielectric body becomes thick, it becomes difficult to change the thickness of the power supply pattern 21. Accordingly, there is a need to reduce the line width of the power supply pattern 21. In the microstripline 20, reducing the line width of the power supply pattern 21 has difficulties when manufacturing. Accordingly, by forming on the back surface 31*b* of the film 31, the line width of the power supply ground pattern 22 is maintained at a desired width length. The microstripline 20 transmits an electromagnetic wave (electric power) by an electric field from the power supply pattern 21 toward the power supply ground pattern 22 through the dielectric body (film 31) and a magnetic field surrounding the circumference of the power supply pattern 21. The microstripline 20, for example, transmits an electric wave (signal) received by the patch antenna 30 to a receiving section.

The patch antenna 30 is an unbalanced antenna that receives an electric wave. The patch antenna 30 receives, for example, a circularly polarized wave, such as an electric wave of an electric toll collection system (ETC). The patch antenna 30 includes the film 31, an antenna pattern 32, and an antenna ground pattern 33. The film 31 has dielectricity and is formed in a sheet shape. In the film 31, for example, a dielectric constant (ε) is approximately three, and the thickness in the lamination direction is approximately 250 μm.

The antenna pattern 32 is formed on the film 31. The antenna pattern 32 is formed by, for example, printing (for example, screen-printing) a conductor, such as a silver paste, on the film 31. The antenna pattern 32 is formed on an upper side, in the lamination direction, of the film 31, i.e., on the surface 31*a* of the film 31. In other words, the antenna pattern 32 is formed on the power supply pattern 21 side of the film 31. The size and shape of the antenna pattern 32 are decided correspondingly to an electric wave to be received, and, for example, the antenna pattern 32 is formed in an almost rectangle shape. The antenna pattern 32 is provided on an inner wall surface 12*a* of the lower case 12 with the film 31 interposed therebetween and is positioned in the inner space portion Q. The antenna pattern 32 is connected to one end of the power supply pattern 21.

The antenna ground pattern 33 is a conductive pattern. As illustrated in FIG. 3, the antenna ground pattern 33 is directly formed on an outer wall surface 12*b* of a wall portion of the lower case 12. That is, the antenna ground pattern 33 is not formed on the back surface 31*b* of the film 31, unlike the power supply ground pattern 22. The antenna ground pattern 33 is formed by, for example, pasting a conductor, such as a copper foil tape, on an outer wall surface 12*b* of the lower case 12. The antenna ground pattern 33 is formed so as to be larger than the antenna pattern 32 and is positioned so as to face, in the lamination direction, the antenna pattern 32. The antenna ground pattern 33 is electrically independent of the power supply ground pattern 22 without being electrically conductive therewith. The antenna ground pattern 33 functions as a ground, which is a reference potential of the antenna pattern 32. In this connection, on the back surface 31*b* of the film 31, the power supply ground pattern 22 is not formed at a place that faces the antenna ground pattern 33 (refer to FIG. 3).

Figure 6:
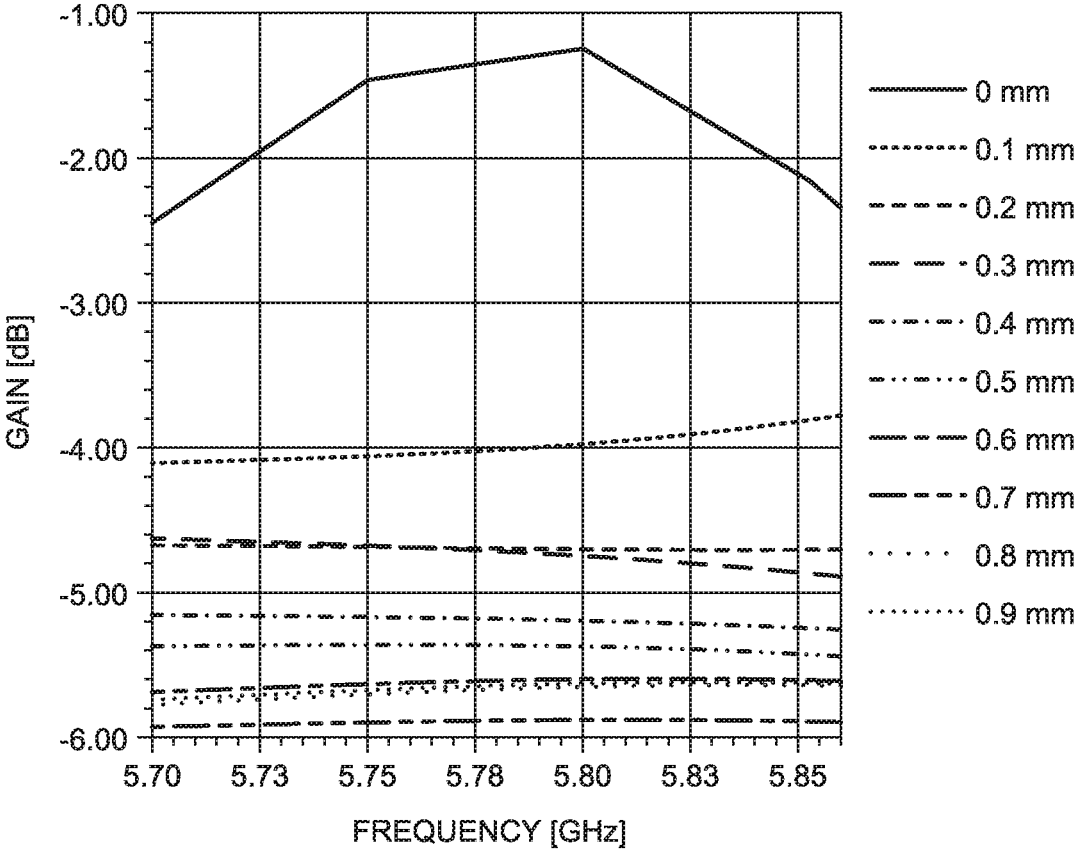
FIG. 6 is a diagram illustrating a gain reduction due to an air layer in the antenna unit according to the first embodiment.

The patch antenna 30 is assembled in the case 10 such that the inner wall surface 12*a* of the lower case 12 has thereon the film 31 having the antenna pattern 32 formed on the surface 31*a* thereof. The patch antenna 30 is fixed by, for example, pasting the back surface 31*b* of the film 31 on the inner wall surface 12*a* of the lower case 12 with a double-sided tape. Here, in the patch antenna 30, there is a need to densely fix between the back surface 31*b* of the film 31 and the inner wall surface 12*a* of the lower case 12. FIG. 6 is a diagram illustrating a gain reduction due to an air layer in the antenna unit 1 according to the first embodiment. In FIG. 6, a vertical axis represents gain (dB) and a horizontal axis represents frequency (GHz). FIG. 6 is a graph illustrating gain for a distance between the back surface 31*b* of the film 31 and the inner wall surface 12*a* of the lower case 12, the distance changing by 0.1 mm, from 0.0 mm to 0.9 mm. There is a tendency that, as the distance between the back surface 31*b* of the film 31 and the inner wall surface 12*a* of the lower case 12 becomes larger, the gain becomes lower. For example, in the antenna unit 1, when the frequency is 5.8 GHz, in the case where the distance between the back surface 31*b* of the film 31 and the inner wall surface 12*a* of the lower case 12 is 0 mm, the gain improves by approximately 3 dB as compared with the case where the distance is 0.1 mm. In this way, in the antenna unit 1, it is important to densely fix between the back surface 31*b* of the film 31 and the inner wall surfaces 12*a* of the lower case 12 and to eliminate an air layer.

In the patch antenna 30, in a state where an air layer between the back surface 31*b* of the film 31 and the inner wall surface 12*a* of the lower case 12 is eliminated, the antenna pattern 32, the film 31, the lower case 12, and the antenna ground pattern 33 have been laminated in this order from the upper side toward the lower side in the lamination direction. In the patch antenna 30, the film 31 and the lower case 12 are interposed as a dielectric body between the antenna pattern 32 and the antenna ground pattern 33. With this configuration, in the patch antenna 30, as compared with a case where only the film 31 is interposed as a dielectric body therebetween, it is possible to increase the thickness of the dielectric body, thereby suppressing the lowering of the antenna gain.

Figure 7:
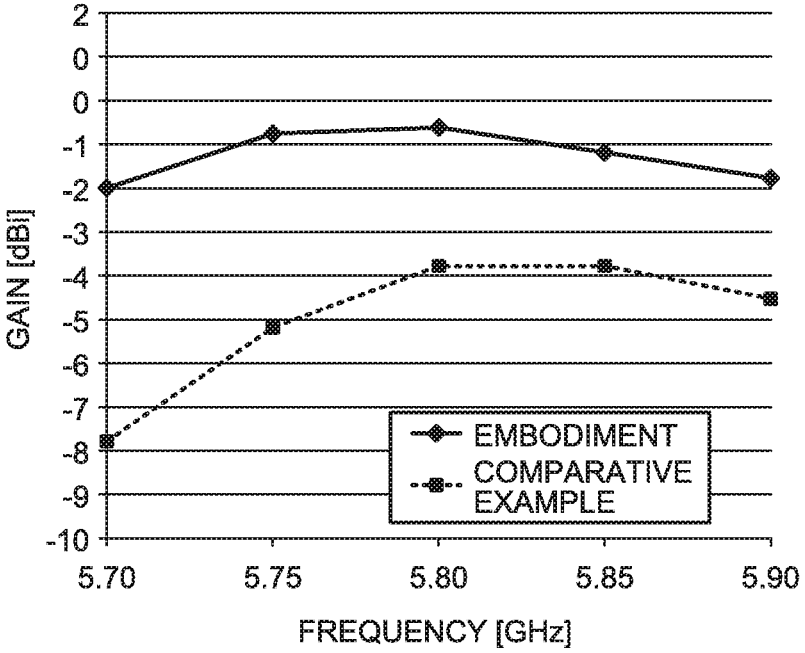
FIG. 7 is a diagram illustrating a comparative example of a gain between the antenna unit according to the first embodiment and an antenna unit according to a comparative example.

FIG. 7 is a diagram illustrating a comparative example of a gain between the antenna unit 1 according to the first embodiment and an antenna unit (not illustrated) according to a comparative example. In FIG. 7, a vertical axis represents gain (dBi) and a horizontal axis represents frequency (GHz). In the antenna unit according to the comparative example, the antenna ground pattern 33 is formed on the back surface 31*b* of the film 31. For this reason, in the antenna unit according to the comparative example, the dielectric body is thinner than the antenna unit 1 according to the first embodiment. In the antenna unit according to the comparative example, for example, as illustrated in FIG. 7, when the frequency is 5.8 GHz, the gain is approximately −3.8 dBi. On the other hand, in the antenna unit 1 according to the first embodiment, when the frequency is 5.8 GHz, the gain is approximately −0.8 dBi. Thus, in the antenna unit 1 according to the first embodiment, by increasing the thickness of the dielectric body by an amount corresponding to the thickness of the lower case 12, it is possible to improve the gain by approximately 3 dBi.

As described in the above, the antenna unit 1 according to the embodiment includes the patch antenna 30 and the case 10. The patch antenna 30 includes the conductive antenna pattern 32 and the antenna ground pattern 33 that functions as a ground of the antenna pattern 32 and receives an electric wave. The case 10 has dielectricity and is provided with the patch antenna 30. The antenna pattern 32 is provided on the inner wall surface 12*a* of the wall portion of the case 10. The antenna ground pattern 33 is formed on the outer wall surface 12*b* of the wall portion of the case 10 and is positioned so as to face the antenna pattern 32.

With this configuration, the antenna unit 1 can secure proper antenna gain by the thickness of the wall portion of the lower case 12 of the case 10. In the antenna unit 1, there is no need to use a substrate by using the wall portion of the lower case 12 as a dielectric body of the patch antenna 30, thereby suppressing an increase in the number of parts. In the antenna unit 1, the shape of the antenna pattern 32 can be maintained by the inner wall surface 12*a* of the lower case 12. As a result, in the antenna unit 1, the patch antenna 30 can be assembled in the case 10 properly. In the antenna unit 1, it is also possible to manufacture the patch antenna 30 at the time of manufacturing the case 10, thereby suppressing an increase in the number of manufacturing processes. Moreover, in the antenna unit 1, it is possible to suppress an increase in a manufacturing cost.

In the above-described antenna unit 1, the antenna pattern 32 is provided on the inner wall surface 12*a* of the case 10 and is accommodated in the inner space portion Q of the case 10. The antenna ground pattern 33 is formed on the outer wall surface 12*b* of the case 10. With this configuration, in the antenna unit 1, since the antenna pattern 32 is accommodated in the inner space portion Q of the case 10, it is possible to protect the antenna pattern 32.

In the above-described antenna unit 1, the patch antenna 30 includes the sheet-shaped film 31 having dielectricity. The antenna pattern 32 is formed on the surface 31*a* of the film 31 and is provided on the inner wall surface 12*a* of the case 10 with the concerned film 31 interposed therebetween. With this configuration, in the antenna unit 1, since the patch antenna 30 can be formed by fixing the film 31 to the inner wall surface 12*a* of the case 10, in addition to the securing of the antenna gain of the patch antenna 30, it is possible to improve the installation ability of the patch antenna 30.

The above-described antenna unit 1 includes the microstripline 20 that transmits electric power to the patch antenna 30. The microstripline 20 includes the conductive power supply pattern 21 and the power supply ground pattern 22 that functions as a ground of the power supply pattern 21. The power supply pattern 21 is formed on the surface 31*a* of the film 31. The power supply ground pattern 22 is formed on the back surface 31*b* of the film 31 and is positioned so as to face the power supply pattern 21. With this configuration, in the antenna unit 1, the microstripline 20 can be formed properly in addition to the securing of the antenna gain of the patch antenna 30.

Second Embodiment

Next, an antenna unit 1A according to a second embodiment will be described. It should be noted that, in the second embodiment, a constitutional element equivalent to that in the first embodiment is provided with the same reference number, and the detailed description for it is omitted. The antenna unit 1A according to the second embodiment is different from the antenna unit 1 of the first embodiment in a point that the antenna pattern 32 is directly formed on the inner wall surface 12*a* of the lower case 12, without forming on the film 31.

Figure 8:
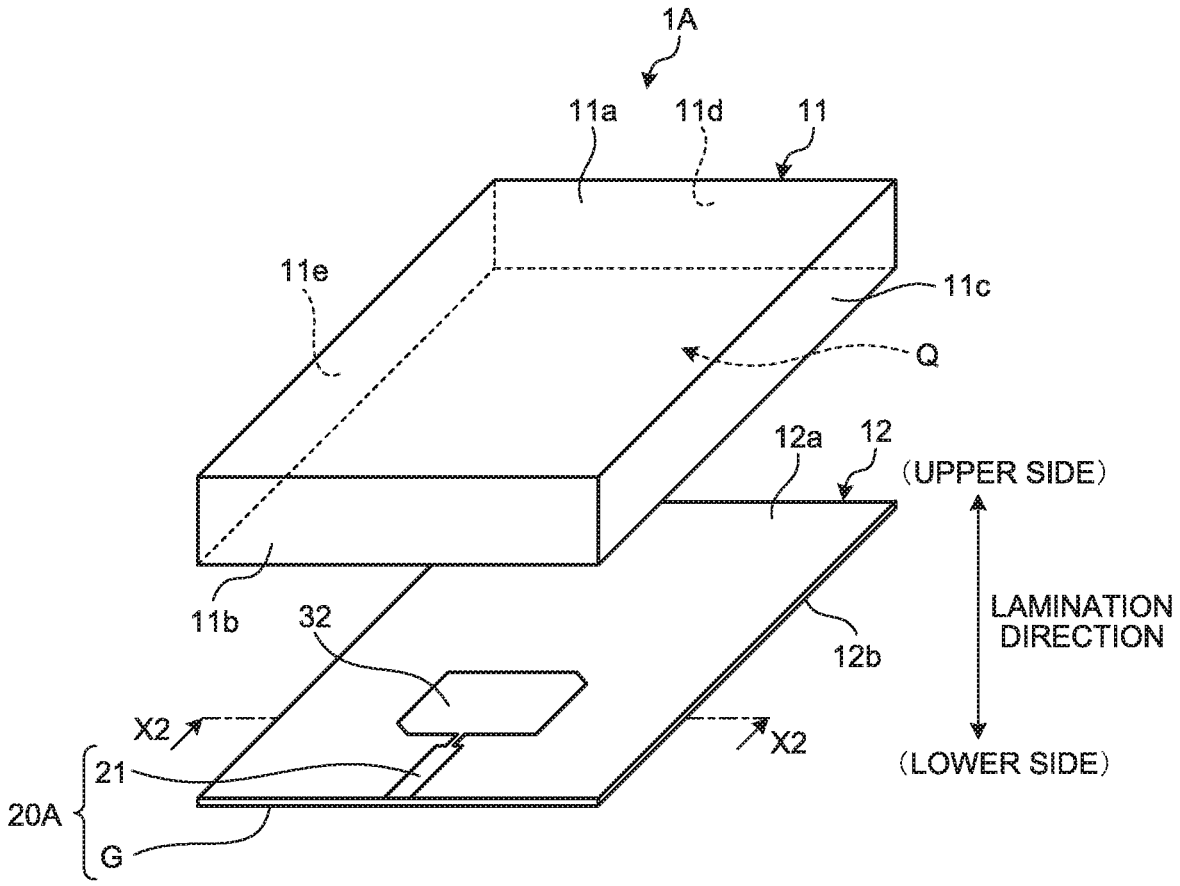
FIG. 8 is an exploded perspective view illustrating a configuration example of an antenna unit according to a second embodiment.
Figure 9:
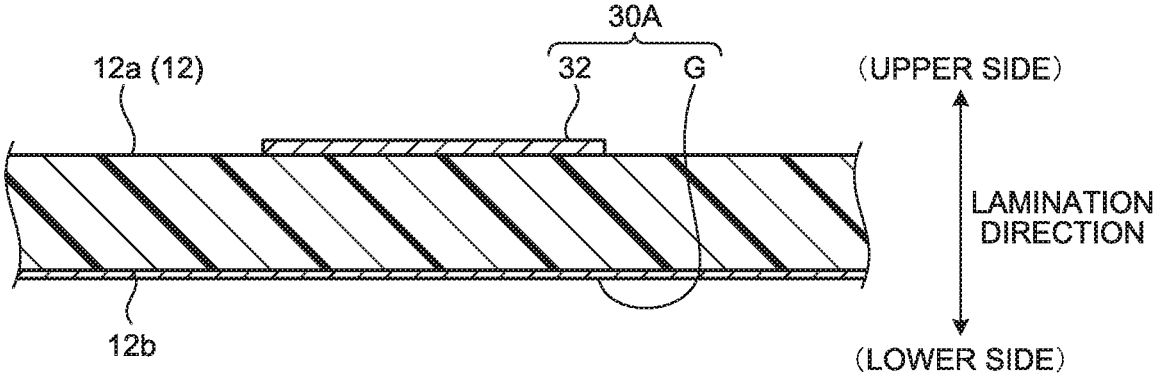
FIG. 9 is a sectional view along an X2-X2 line in FIG. 8.

As illustrated in FIG. 8 and FIG. 9, the antenna unit 1A includes an upper case 11, a lower case 12, a microstripline 20A, and a patch antenna 30A. The microstripline 20A includes a power supply pattern 21 and a ground pattern G.

The power supply pattern 21 is directly formed on the inner wall surface 12*a* of the lower case 12. The power supply pattern 21 is formed by, for example, printing (for example, screen-printing) a conductor, such as a silver paste, on an inner wall surface 12*a* of the lower case 12. The power supply pattern 21 is formed in a line shape, in which one end is connected to the antenna pattern 32 and the other end is connected to a receiving section (not illustrated) that receives a signal.

The ground pattern G is a conductive pattern. The ground pattern G is directly formed on an outer wall surface 12*b* of the lower case 12. The ground pattern G is formed by, for example, pasting a conductor, such as a copper foil tape, on the outer wall surface 12*b* of the lower case 12. The ground pattern G is positioned so as to face the power supply pattern 21 along the lamination direction and functions as a ground that is a reference potential of the power supply pattern 21.

In the microstripline 20A, since the ground pattern G is formed on the outer wall surface 12*b* of the lower case 12, the dielectric body (lower case 12) becomes thicker than the dielectric body (film 31) of the microstripline 20 of the first embodiment. Accordingly, there is a need to reduce the line width of the power supply pattern 21. In this case, the microstripline 20A is able to have the line width of the power supply pattern 21 having a desired line width by adjusting the thickness of the lower case 12.

The patch antenna 30A includes an antenna pattern 32 and a ground pattern G. The antenna pattern 32 is directly formed on the inner wall surface 12*a* of the lower case 12. The antenna pattern 32 is formed by, for example, printing (for example, screen-printing) a conductor, such as a silver paste, on the inner wall surface 12*a* of the lower case 12. The antenna pattern 32 is positioned in the inner space portion Q and is connected to one end of the power supply pattern 21.

The ground pattern G is formed to be larger than the antenna pattern 32 and is positioned so as to face, in the lamination direction, the antenna pattern 32. The ground pattern G functions also as a ground of the antenna pattern 32. That is, the ground pattern G is the common ground of the antenna pattern 32 and the power supply pattern 21.

As described in the above, in the antenna unit 1A according to the second embodiment, the antenna pattern 32 is formed on the inner wall surface 12*a* of the lower case 12. With this configuration, in the antenna unit 1A, proper antenna gain can be secured with the thickness of the wall portion of the lower case 12. In the antenna unit 1A, since the wall portion of the lower case 12 is used as a dielectric body of the patch antenna 30A, there is no need to use a substrate. Accordingly, it is possible to suppress an increase in the number of parts. In the antenna unit 1A, since the film 31 is not use, it is possible to suppress an increase in the number of parts more. In the antenna unit 1A, the shape of the antenna pattern 32 can be maintained by the inner wall surface 12*a* of the lower case 12. As a result, in the antenna unit 1A, the patch antenna 30A can be assembled in the case 10 properly. In the antenna unit 1A, the patch antenna 30A can also be manufactured simultaneously at the time of manufacturing the case 10, whereby it is possible to suppress an increase in the number of manufacturing processes. Moreover, in the antenna unit 1A, it is possible to suppress an increase in manufacturing cost.

Modified Example

Next, a modified example of the first and second embodiments will be described. Although the patch antennas 30 and 30A have been described with reference to the example of receiving an electric wave of ETC, they are not limited to this example and may be applied to an antenna that receives an electric wave, such as a global positioning System (GPS), satellite broadcasting, and the like.

Although the patch antennas 30 and 30A have been described with reference to the example of receiving an electric wave, they may be made to transmit an electric wave.

Although the antenna units 1 and 1A have been described with reference to the example of transmitting electric power by the microstriplines 20 and 20A, they are not limited to this example and may transmit electric power by using a coaxial cable.

Although the patch antenna 30 has been described with reference to the example in which the back surface 31*b* of the film 31 is pasted on the inner wall surface 12*a* of the lower case 12 with a double-sided tape, the patch antenna 30 is not limited to this example and the back surface 31*b* of the film 31 may be pasted on the inner wall surface 12*a* of the lower case 12 with an adhesive or the like.

Although the antenna ground pattern 33 and the ground pattern G have been described with reference to the example in which they are formed by pasting a conductor, such as a copper foil tape, on an outer wall surface 12*b* of the lower case 12, they are not limited to this example and they may be formed by printing a conductor, such as a silver paste.

Although the power supply pattern 21, the power supply ground pattern 22, and the antenna pattern 32 have been described with reference to the example in which they are formed by the screen-printing, they may not be limited to this, and may be formed by gravure printing, flexographic printing, or the like, and may be formed by the other methods.

A plurality of patch antennas 30, a plurality of patch antennas 30A, a plurality of microstriplines 20, and a plurality of microstriplines 20A may be provided in the case 10.

Although the dielectric constant (c) of each of the film 31 and the lower case 12 is approximately three, the dielectric constant (c) is not limited to this and may be set as appropriate in accordance with the frequency of a target electric wave.

Although the thickness, in the lamination direction, of the film 31 is approximately 250 μm, the thickness is not limited to this and may be set as appropriate.

In the antenna unit according to the embodiment, an antenna pattern is provided on a wall surface on one side of a wall portion of a case, and a first ground pattern is formed on a wall surface on the other side of the wall portion and is positioned so as to face the antenna pattern. Accordingly, the wall portion of the case can be used as a dielectric body of the antenna. As a result, it is possible to assemble the antenna in the case properly.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An antenna unit, comprising:

an antenna that includes a conductive antenna pattern and a first ground pattern that functions as ground of the antenna pattern, the antenna transmitting or receiving an electric wave;

a case that has dielectricity, the case being provided with the antenna, and a microstripline that includes a conductive power supply pattern and a second ground pattern functioning as ground of the power supply pattern and is configured to transmit electric power to the antenna, wherein the case includes an upper case and a lower case, the upper case forms an inner space portion and has an opening portion formed on a lower side in a lamination direction, the lower case is engaged with the opening portion of the upper case, the antenna pattern is provided on an inner wall surface of the lower case on a side of the inner space portion and is accommodated in the inner space portion, and the first ground pattern is formed on an outer wall surface of the lower case on the opposite side of the inner space portion and is positioned so as to face the antenna pattern, the antenna includes a sheet-shaped film having dielectricity, the antenna pattern is formed on a film surface on one side of the film and is provided on the inner wall surface of the lower case with the film interposed therebetween, the power supply pattern is formed on the film surface on the one side of the film, and the second ground pattern is formed on a film surface on the other side of the film and is positioned so as to face the power supply pattern and is positioned so as not to face the antenna pattern.

2. The antenna unit according to claim 1, wherein the antenna pattern is formed on the inner wall surface of the lower case.

* * * * *